US007571880B2

(12) United States Patent
Perez

(10) Patent No.: US 7,571,880 B2
(45) Date of Patent: Aug. 11, 2009

(54) MOUNTING HOOK FOR A TUBE IN THE EXHAUST SYSTEM OF A MOTOR VEHICLE

(75) Inventor: David Perez, Belfort (FR)

(73) Assignee: Faurecia Systemes d'Echappement, Nanterre (FR)

( * ) Notice: Subject to any disclaimer, the term of this patent is extended or adjusted under 35 U.S.C. 154(b) by 69 days.

(21) Appl. No.: 10/553,437

(22) PCT Filed: Apr. 14, 2004

(86) PCT No.: PCT/FR2004/000920

§ 371 (c)(1),
(2), (4) Date: Jun. 22, 2006

(87) PCT Pub. No.: WO2004/092554

PCT Pub. Date: Oct. 28, 2004

(65) Prior Publication Data

US 2007/0170316 A1 Jul. 26, 2007

(30) Foreign Application Priority Data

Apr. 15, 2003 (FR) ..... 03 04722

(51) Int. Cl.
*F16L 3/05* (2006.01)

(52) U.S. Cl. ..... 248/58; 248/65

(58) Field of Classification Search ..... 248/58, 248/59, 60, 61, 63, 65; 180/309, 296
See application file for complete search history.

(56) References Cited

U.S. PATENT DOCUMENTS

| | | | | |
|---|---|---|---|---|
| 1,576,307 | A * | 3/1926 | Casey | 248/59 |
| 3,853,148 | A | 12/1974 | Kirkham et al. | |
| 4,116,411 | A * | 9/1978 | Masuda | 248/60 |
| 4,465,252 | A * | 8/1984 | Donovan et al. | 248/60 |
| 6,758,300 | B2 * | 7/2004 | Kromis et al. | 180/309 |

FOREIGN PATENT DOCUMENTS

| | | |
|---|---|---|
| DE | 85 09 396 | 7/1985 |
| DE | 197 16 165 | 10/1998 |
| FR | 937 632 | 8/1948 |

* cited by examiner

*Primary Examiner*—Ramon O Ramirez
(74) *Attorney, Agent, or Firm*—Young & Thompson

(57) ABSTRACT

A mounting hook for a tube (2) in the exhaust system of a motor vehicle, includes a pin (3) with an essentially cylindrical fixing end (7), at least one spacer and at least one spacer (8) with a mounting piece (12), for the fixing end, at a first end thereof and at least one fixing plate (11) for a tube (2), at the second end thereof. The at least one mounting piece (12) and the fixing end (7) are joined by welding. The at least one mounting piece and the fixing end cooperate via a planar contact matching the angle such as to permit an adjustment of the distance between the pin and the at least one fixing plate for a tube before welding.

12 Claims, 3 Drawing Sheets

MOUNTING HOOK FOR A TUBE IN THE EXHAUST SYSTEM OF A MOTOR VEHICLE

Figure 1:
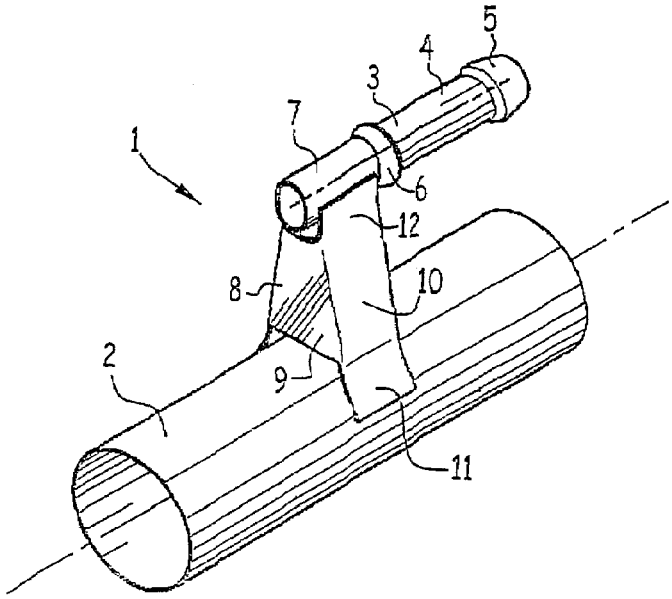

The invention relates to a two-part suspension hook for a tube and in particular a motor vehicle exhaust tract tube.

Motor vehicle exhaust tracts are suspended below the body of vehicles by means of hooks. In particular, two-part hooks are known which are constituted, on the one hand, by a pin which is intended to co-operate with a rubber bobbin which is arranged below the vehicle and, on the other hand, a spacer which is intended to form the connection between the pin and the exhaust tract. This spacer comprises in particular an end which is in the form of a semi-circular channel and which is intended to co-operate with the pin, and to which the pin is welded. Generally, the pin is mounted so as to be parallel with the exhaust tract and perpendicular relative to the spacer. Under these conditions, when the hooks are mounted, and when welding is carried out, it is possible to move the spacer longitudinally relative to the pin and to pivot the spacer about the pin. However, it is not possible to adjust the relative position of the pin and the spacer in order to adjust the spacing between the axis of the pin and the axis of the exhaust tract to which it will be fixed. This is a disadvantage which makes the assembly of the vehicles complex.

The object of the present invention is to overcome this disadvantage by providing a hook which allows more flexible adjustment when mounting the hook on the vehicle.

To this end, the subject-matter of the invention is a suspension hook for a motor vehicle exhaust tract tube constituted by a pin which comprises a generally cylindrical end-piece for fixing to at least one spacer and at least one spacer comprising, at a first end, at least one lug for fixing to the fixing end-piece, and, at a second end, at least one plate for fixing to a tube, the at least one fixing lug and the fixing end-piece being fixed by means of welding, the at least one fixing lug and the fixing end-piece co-operating by means of a contact of the type involving a plane on a generating line in order to be able to adjust, before welding, the spacing of the pin and the at least one plate for fixing to a tube.

The at least one fixing plate can be shaped so as to be able to co-operate with a tube which is generally arranged perpendicularly relative to the longitudinal axis of the spacer.

The spacer may comprise two fixing plates and two generally planar fixing lugs, the end-piece for fixing to the pin being arranged between the two fixing lugs generally perpendicularly relative to the longitudinal axis of the spacer.

The fixing end-piece may have a circular cross-section, the fixing lugs of the spacer being generally parallel with each other, and the fixing lugs being welded to the fixing end-piece by means of laser welding.

The fixing end-piece may also comprise two longitudinal flat surfaces which are parallel with each other, the fixing lugs being fillet-welded to those flat surfaces.

The hook may comprise at least one spacer which comprises a single fixing lug in the form of a channel which extends along the longitudinal axis of the spacer, the fixing end-piece being arranged in the channel parallel with the longitudinal axis of the spacer.

The channel-shaped fixing lug of the spacer may comprise two faces which are generally at right-angles, the fixing end-piece comprising at least one longitudinal flat surface which co-operates with a face of the channel.

Advantageously, the hook comprises two spacers which have a fixing lug in the form of a channel.

The invention also relates to a spacer of a hook which comprises a body which has a large, generally trapezoidal face and two lateral faces which are each extended, at one side, from the side of the small base of the large trapezoidal face, by a planar lug which is generally parallel with the longitudinal axis of the spacer and, at the other side, from the side of the large base of the large trapezoidal face, by a plate which is shaped in order to be able to co-operate with a tube which is perpendicular relative to the large face of the spacer.

Finally, the invention relates to a spacer which comprises a plate which is shaped so as to be able to co-operate with a tube and a fixing lug which is arranged in the continuation of the plate, the lug being in the form of a channel.

A hook according to the invention may, for example, be used to suspend at least one tube for an exhaust tract of a motor vehicle.

Figure 2:
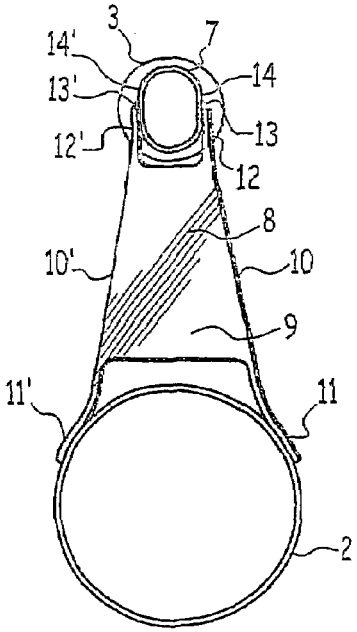
Figure 3:
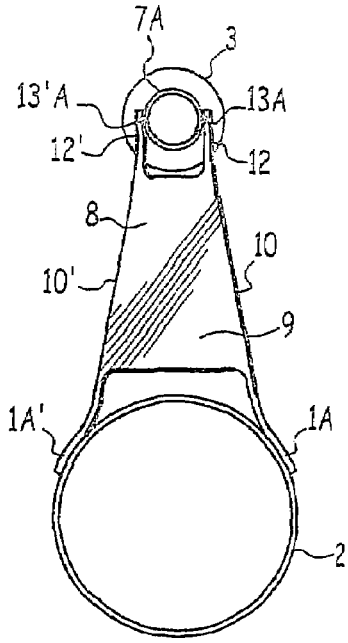
Figure 4:
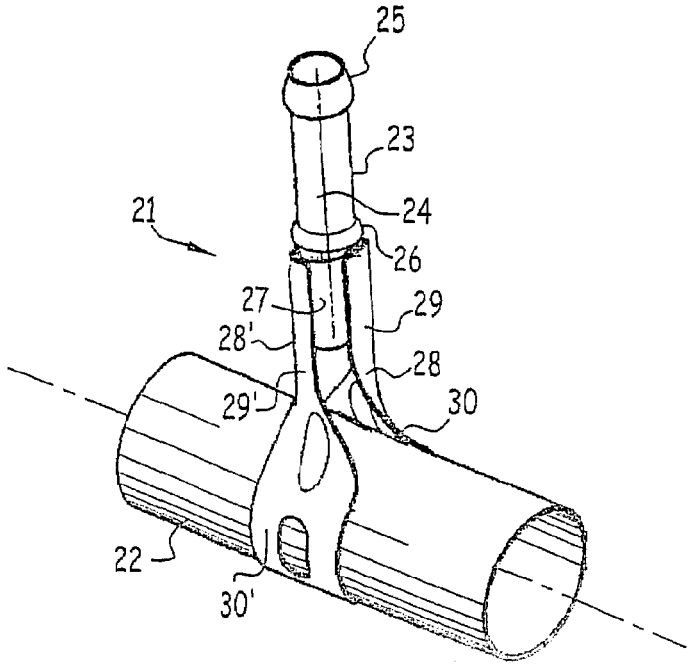
Figure 5A:
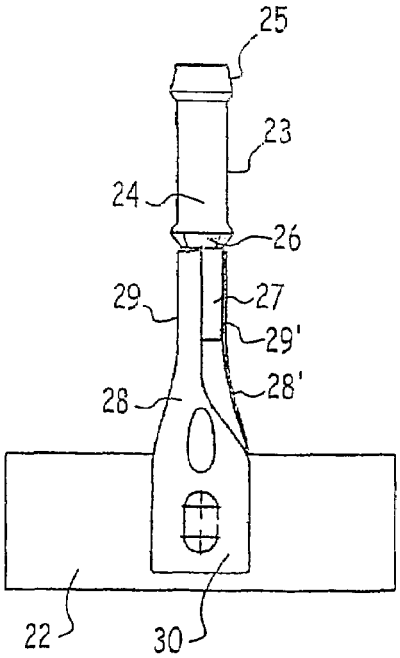
Figure 5B:
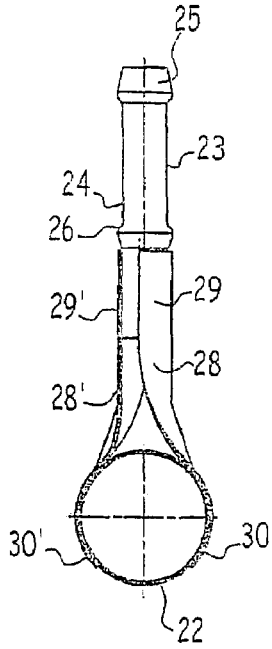
Figure 5C:
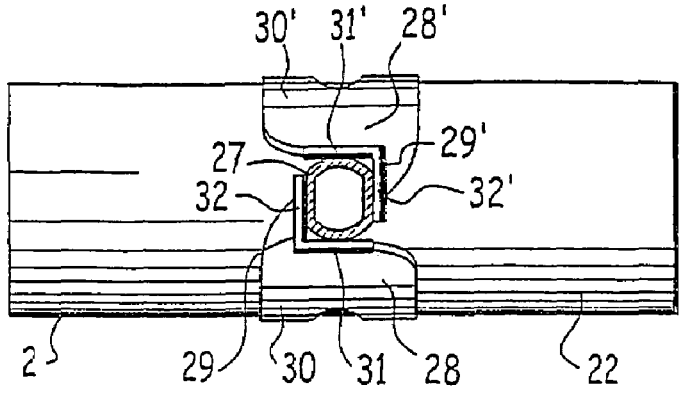
Figure 6:
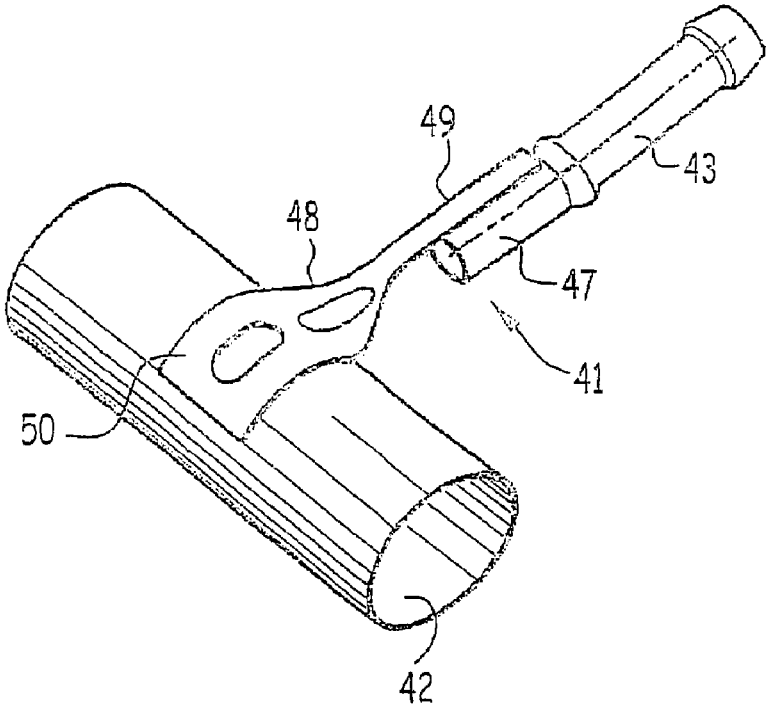

The invention will now be described in greater detail and in a non-limiting manner with reference to the appended Figures, in which:

FIG. 1 is a perspective view of a hook which is mounted on a conduit comprising a pin which is parallel with the conduit, FIG. 2 is a front view of a first embodiment of a hook comprising a pin which is parallel with the conduit, FIG. 3 is a front view of a second embodiment of a hook comprising a pin which is parallel with the conduit, FIG. 4 is a perspective view of a two-part hook comprising a pin which is perpendicular relative to the conduit supported by a hook, FIGS. 5A, 5B, 5C are front, side and plan views, respectively, of a two-part hook comprising a pin which is perpendicular relative to the suspended conduit, FIG. 6 is a perspective view of a fixing hook comprising a pin which is perpendicular relative to the supported conduit and a single spacer.

The hook which is generally designated 1 in FIG. 1 and which is intended to support the conduit 2 comprises two portions: on the one hand, a pin 3 and, on the other hand, a spacer 8, the spacer 8 being arranged between the pin 3 and the tube 2. The pin 3 comprises a cylindrical body 4 having, at a first end, a protuberance 5 and, at a second end, a protuberance 6 which is intended to co-operate with a rubber bobbin which comprises a hole and which is fixed to the vehicle. The cylindrical body 4 is extended at one side by means of a fixing end-piece 7 which is intended to fix the pin to the spacer 8. The spacer 8 comprises a trapezoidal main face 9 and two lateral faces 10 (only one of which can be seen in the Figures) which extend towards the large base of the trapezoidal face 9 by means of plates 11 for fixing to the tube 2, and at the side of the small base of the main trapezoidal face 9 by means of lugs 12 for fixing to the fixing end-piece 7 of the pin 3. This spacer can be produced, for example, from a metal sheet which is cut and folded so as to give it the necessary shape for its use.

As can be seen in FIG. 2, the fixing plates 11 and 11' which extend the lateral faces 10 and 10' of the spacer 8, in order to allow the spacer 8 to be fixed to the tube 2, are shaped so as to conform to the shape of the tube in the contact zones of the plates 11 and 11' for fixing to the tube 2.

As can also be seen in FIG. 2, the end-piece 7 for fixing the pin 3 to the spacer 8 has a generally cylindrical shape which comprises two longitudinal flat surfaces 14 and 14' which are inserted between the fixing lugs 12 and 12' which extend the lateral faces 10 and 10' of the spacer 8. Along the contact lines 13 and 13' of the fixing lugs 12 and 12' with the flat surfaces 14 and 14' of the end-piece 7, the fixing lugs 12 and 12' are fillet-welded to the fixing end-piece 7. As can be seen in FIG. 2, and provided that the fixing lugs 12 and 12' are sufficiently tall, before the pin is welded to the spacer 8, it is possible to adjust the position of the pin relative to this spacer so as to adjust the height which separates the axis of the pin and the axis of the tube 2 which is intended to be supported by the hook. In order to adjust this control means, it is sufficient to vertically slide the fixing end-piece 7 between the fixing lugs 12 and 12' and, when the position of the pin is the desired position, to carry out the welding operation. Under these conditions, it is also possible to slide the pin along the longitudinal axis thereof (illustrated in FIG. 1) in order to adjust the position thereof relative to the spacer and it is also possible to slightly pivot the pin so as to adjust the angle between the pin and the spacer.

In one construction variant illustrated in FIG. 3, the spacer 8 comprises, in the same manner, two lateral faces 10 and 10' which extend by means of plates 11, 11' for fixing to the tubes and, by means of lugs 12, 12' for fixing to the fixing end-piece 7A of the pin 3. In this construction variant, the fixing lugs 12 and 12' are parallel with each other and the fixing end-piece 7A of the pin 3 has a circular cross-section. The diameter of the fixing end-piece 7A is equal to the spacing of the fixing lugs 12 and 12' and the fixing end-piece 7*a* is inserted between the fixing lugs 12 and 12'. At the contact points 13A and 13'A of the fixing lugs 12 and 12' with the fixing end-piece 7A, the fixing lugs 12 and 12' are welded by means of laser welding. As can be seen in FIG. 3, if the fixing lugs 12 and 12' are sufficiently tall, it is possible to adjust the position of the pin 3 relative to the axis of the tube 2 supported by the hook. To this end, it is sufficient, before welding the fixing lugs 12 and 12' to the fixing end-piece 7A, to slide the fixing end-piece 7A between the fixing lugs 12 and 12' as far as the position which corresponds to the adjustments which are made for the height between the axis of the pin 3 and the axis of the tube 2. It is also possible to adjust the position of the pin 3 relative to the spacer 8 by sliding the pin 3 along the longitudinal axis thereof (illustrated in FIG. 1) between the fixing lugs 12 and 12'. Finally, it is possible to adjust the angle which is formed between the pin 3 and the spacer 8, by slightly pivoting the pin between the fixing lugs 12 and 12'.

These two arrangements allow a two-part hook to be obtained which comprises a pin which is parallel with the axis of the tube which is intended to be supported by the hook, and a spacer which forms the connection between the pin and the tube, so as to be able to be adjusted in accordance with at least three degrees of freedom which are, on the one hand, the spacing which separates the axis of the pin and the axis of the tube which is intended to be supported by the hook and, on the other hand, the angle which the pin forms with the spacer which connects the pin and the tube which is intended to be supported and finally the spacing between the spacer and the cylindrical body of the pin which is intended to co-operate with a rubber bobbin.

In a different embodiment, illustrated in FIGS. 4 and 5A, B, C, the hook which is generally designated 21 comprises a pin 23 which is identical or comparable to the pin 3 described above, but which is arranged perpendicularly relative to the axis of the tube 22 which is intended to be supported by the hook. The hook also comprises two spacers 29 and 29' which are intended to connect the pin 23 and the tube 22. Each spacer 28 and 28' comprises a plate 30, 30' which is intended to co-operate with the tube 22 and which has, for this purpose, the shape of a cylindrical portion which complements the shape of the tube 22. Each plate 30, 30' extends along the longitudinal axis of the spacer 28 or 28' by means of a fixing lug 29 or 29; in the shape of a channel. The fixing lugs 29 and 29' surround the fixing end-piece 27 of the pin 23 which is arranged along the longitudinal axis of the fixing lugs 28 and 28'. As can be seen in FIG. 5C, the fixing lugs 29 or 29' each comprise at one side a flap 31 or 31' whose face is parallel with the axis of the tube 22 and a flap 32 or 32' whose face is perpendicular relative to the axis of the tube 22. The flaps 31 and 32 or 31' and 32' form a channel in which the fixing end-piece 27 of the pin 23 is arranged. The flaps 31 and 32 of the fixing lug 29 and the flaps 31' and 32' of the fixing lug 29' co-operate with the surface of the fixing end-piece 27 which may have a circular cross-section as well as a cross-section which comprises flat surfaces.

As in the above example, the flaps 31 and 32 of the fixing lug 29 and 31' and 32' of the fixing lug 29' are welded, for example, by means of laser welding to the fixing end-piece 27. In this case, before welding the fixing lugs 29 and 29' to the end-piece 27, the position of the end-piece 27 can be adjusted relative to the fixing lugs by sliding the pin 23 relative to the spacers 28 and 28'. It is thus possible to adjust the height which separates the axis of the supported tube 22 and the cylindrical body 24 of the pin 23 in order to adjust it to the desired arrangement for the tube 22 relative to the point at which it is fixed to the vehicle. Under these conditions, the two-part hook comprises only one degree of freedom which is the degree corresponding to the adjustment of the height separating the axis of the supported tube and the fixing point of the hook.

In one variant which is illustrated in FIG. 6, the hook which is generally designated 41 comprises a pin 43 which is identical to the pin 23 of the example above, and a single spacer 34 which is identical to one of the spacers 48 or 28' of the example above. The spacer 48 comprises a fixing lug 49 which is in the form of a channel and which is welded to an end-piece 47 which is for fixing the pin 43 and which is arranged longitudinally in the fixing lug 49 in the shape of a channel, and a fixing plate 50 which is intended to co-operate with a tube 42. The fixing lug 49 is welded to the fixing end-piece either by means of fillet or laser welding.

The hooks described above allow the height which separates the axis of the tube carried by the hook and the fixing point of the tube with respect to the vehicle to be adjusted, since the spacers co-operate with the cylindrical fixing pin, by means of a contact of the type involving a plane on a generating line. A contact of the type involving a plane on a generating line is a contact which corresponds to that of a regular convex surface which rests on the plane tangent to this surface along a straight generating line. This contact is in particular that of a cylinder which is positioned on a plane. When the surface (the cylinder) co-operates with a single plane, the contact has three degrees of freedom which correspond to a translation which is parallel with the contact line, a translation which is perpendicular relative to the contact line and a rotation in the contact plane. When the surface co-operates with two separate planes (as is the case with the channel), the contact allows only a translation parallel with the contact line. In all cases, this contact allows a relative movement of the pin and the spacer in a direction parallel with the contact line of the spacer on the generating line.

This type of hook is particularly suitable for suspending a thin tube, in particular a tube having a thickness of less than 1 mm, with no sleeve, and, for example, a motor vehicle exhaust tract tube.

The invention claimed is:

1. A suspension hook for a tube (2; 22; 42), said suspension hook comprising:

at least one spacer; and a pin (3', 23', 43) comprising a generally cylindrical end-piece (7, 7A; 27; 47) for fixing to said at least one spacer (8; 28, 28'; 48), said at least one spacer (8, 28, 28', 48) comprising, at a first end, at least one lug (12, 12'; 29, 29';

49) for fixing to the fixing end-piece, and, at a second end, at least one plate for fixing to a tube (11, 11'; 30, 30'; 50), wherein:

the at least one fixing lug (12, 12'; 29, 29'; 49) and the fixing end-piece (7, 7A; 27; 47) being fixed by means of welding, the at least one fixing lug (12, 12'; 29, 29'; 49) and the fixing end-piece (7, 7A; 27; 47) co-operate by means of a contact of the type involving a plane on a generating line wherein:

the spacer (8) comprises two fixing plates (11, 11') and two generally planar fixing lugs (12, 12'), and the end-piece (7, 7A) for fixing of the pin (3) is arranged between the two fixing lugs (12, 12') generally perpendicularly relative to the longitudinal axis of the spacer (8).

2. The suspension hook according to claim 1, wherein:

the fixing end-piece (7A) has a circular cross-section, and the fixing lugs (12, 12') of the spacer (8) are generally parallel with each other and are welded to the fixing end-piece (7A) by means of laser welding.

3. The spacer of the suspension hook according to claim 2, said spacer comprises a body which has a large, generally trapezoidal face (9) and two lateral faces (10, 10') which are each extended, at one side, from the side of the small base of the large trapezoidal face (9), by a planar lug (12, 12') which is generally parallel with the longitudinal axis of the spacer and, at the other side, from the side of the large base of the large trapezoidal face (9), by a plate which is shaped in order to be able to cooperate with a tube which is perpendicular relative to the large trapezoidal face (9) of the spacer.

4. The suspension hook according to claim 1, wherein:

the fixing end-piece (7) comprises two longitudinal flat surfaces (14, 14') which are parallel with each other, and the fixing lugs (12, 12') are fillet-welded to those flat surfaces.

5. The spacer of the suspension hook according to claim 4, said spacer comprises a body which has a large, generally trapezoidal face (9) and two lateral faces (10, 10') which are each extended, at one side, from the side of the small base of the large trapezoidal face (9), by a planar lug (12, 12') which is generally parallel with the longitudinal axis of the spacer and, at the other side, from the side of the large base of the large trapezoidal face (9), by a plate which is shaped in order to be able to co-operate with a tube which is perpendicular relative to the large trapezoidal face (9) of the spacer.

6. The spacer of the suspension hook according to claim 1, said spacer comprising:

a body which has a large, generally trapezoidal face (9) and two lateral faces (10, 10') which are each extended, at one side, from the side of the small base of the large trapezoidal face (9), by a planar lug (12, 12') which is generally parallel with the longitudinal axis of the spacer and, at the other side, from the side of the large base of the large trapezoidal face (9), by a plate which is shaped in order to be able to co-operate with a tube which is perpendicular relative to the large trapezoidal face (9) of the spacer.

7. A suspension hook for a tube (2; 22; 42), said suspension hook comprises:

at least one spacer; and a pin (3; 23; 43) comprising a generally cylindrical end-piece (7, 7A; 27; 47) for fixing to said at least one spacer (8; 28, 28'; 48), said at least one spacer (8; 28; 28'; 48) comprising, at a first end, at least one lug (12, 12'; 29, 29'; 49) for fixing to the fixing end-piece, and, at a second end, at least one plate for fixing to a tube (11, 11'; 30, 30'; 50), wherein:

the at least one fixing lug (12, 12'; 29, 29'; 49) and the fixing end-piece (7, 7A; 27; 47) being fixed by means of welding, the at least one fixing lug (12, 12'; 29, 29'; 49) and the fixing end-piece (7, 7A; 27; 47) co-operate by means of a contact of the type involving a plane on a generating line, and the at least one spacer (28, 28'; 48) comprises a single fixing lug (29, 29'; 49) in the form of a channel which extends along the longitudinal axis of the spacer, and the fixing end-piece (23; 43) is arranged in the channel parallel with the longitudinal axis of the spacer.

8. The suspension hood according to claim 7, wherein:

the channel-shaped fixing lug (29, 29'; 49) of the spacer (28, 28'; 48) comprises two faces (31, 32, 31', 32') which are generally at right-angles, and the fixing end-piece (27; 47) comprises at least one longitudinal flat surface which co-operates with a face of the channel.

9. The suspension hook according to claim 8, comprising two spacers (28, 28').

10. The suspension hook according to claim 7, comprising two spacers (28, 28').

11. The spacer of the suspension hook according to claim 7, said spacer comprising a plate (30, 30', 50) which is shaped so as to be able to co-operate with a tube and a fixing lug (28, 28', 48) which is arranged in the continuation of the plate (30, 30'; 50) along the longitudinal axis of the spacer, the fixing lug (28, 28'; 48) being in the form of a channel.

12. A suspension hook for a tube (2; 22; 42), said suspension hook comprising:

at least one spacer; and a pin (3', 23', 43) comprising a generally cylindrical end-piece (7, 7A; 27; 47) for fixing to at least one spacer (8; 28, 28'; 48), said at least one spacer (8, 28, 28', 48) comprising, at a first end, at least one lug (12, 12'; 29, 29'; 49) for fixing to the fixing end-piece, and, at a second end, at least one plate for fixing to a tube (11, 11'; 30, 30'; 50), wherein:

the at least one fixing lug (12, 12'; 29, 29'; 49) and the fixing end-piece (7, 7A; 27; 47) being fixed by means of welding, the at least one fixing lug (12, 12'; 29, 29'; 49) and the fixing end-piece (7, 7A; 27; 47) co-operate by means of a contact of the type involving a plane on a generating line, the at least one fixing plate (11, 11'; 30, 30'; 50) is shaped so as to be able to cooperate with a tube (2; 22; 42) which is generally arranged perpendicularly relative to the longitudinal axis of the at least one spacer (8; 28, 28'; 48), and the at least one spacer (28, 28'; 48) comprises a single fixing lug (29, 29'; 49) in the form of a channel which extends along the longitudinal axis of the spacer, and in that the fixing end-piece (23; 43) is arranged in the channel parallel with the longitudinal axis of the at least one spacer.

* * * * *

UNITED STATES PATENT AND TRADEMARK OFFICE

CERTIFICATE OF CORRECTION

PATENT NO. : 7,571,880 B2
APPLICATION NO. : 10/553437
DATED : August 11, 2009
INVENTOR(S) : David Perez It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 333 days.

Signed and Sealed this

Seventh Day of September, 2010

David J. Kappos

David J. Kappos
*Director of the United States Patent and Trademark Office*